United States Patent [19]

Markow et al.

[11] 4,092,180

[45] May 30, 1978

[54] MANUFACTURE OF TORSION BARS

[75] Inventors: Edward G. Markow, Oakdale; Benjamin J. Aleck, Jackson Heights, both of N.Y.

[73] Assignee: Grumman Aerospace Corporation, Bethpage, N.Y.

[21] Appl. No.: 793,480

[22] Filed: May 3, 1977

[51] Int. Cl.[2] ..... C21D 9/02

[52] U.S. Cl. ..... 148/12 E; 148/12.4; 148/125

[58] Field of Search ..... 148/12.4, 12 E, 125

[56] References Cited

U.S. PATENT DOCUMENTS

| | | | |
|---|---|---|---|
| 3,473,973 | 10/1969 | Maekawa et al. | 148/125 |
| 3,615,921 | 10/1971 | Delgrosso | 148/125 |
| 3,917,492 | 11/1975 | Backman et al. | 148/12.4 |

*Primary Examiner*—W. Stallard

*Attorney, Agent, or Firm*—Richard G. Geib

[57] ABSTRACT

A method of making high performance torsion bars from austenitic stainless steels which comprises the steps of fabricating a blank complete with splined ends and torsion working said blank below the Md temperature of the material to a stress value above 80–90% of its ultimate. Prior working may be done in tension at below the Md temperature, and subsequent precipitation hardening may be added to the basic process.

19 Claims, 5 Drawing Figures

MANUFACTURE OF TORSION BARS

BACKGROUND OF THE INVENTION

The present invention relates to manufacture of stainless steel products and has particular reference to manufacture of high performance torsion bars for motor vehicles.

The high performance features described below have great value for military vehicles such as tanks which are designed to be capable of maneuvering over large obstructions at increasingly higher speeds while still maintaining acceptable dynamics for the crew.

The desired properties of a high performance torsion bar are a specified torsional stiffness (angle of twist for a given length and twisting moment) and the highest possible cylic angle of twist consistent with survival of a specified number of applications of that twist.

To meet these requirements, the optimal material will have the lowest Young's modulus for its class and the highest cyclic elastic strain capability for the specified cyclic life. The elastic strain capability is usually enhanced by inducing a beneficial state of residual stress in the bar by twisting it beyond its yield point. This twisting leaves the bar ends permanently twisted under no torque. Although the larger the permanent twist the larger the beneficial effect, for each material there is a safe upper limit above which the material is damaged and no benefit accrues. With zero permanent twist, the allowable elastic strain increases with increasing cyclic strength.

It will be seen that among steel bars, the proposed procedure produces a steel with 10–20% reduction in Young's modulus with a high cyclic elastic strain capability because of its very high cyclic strength aided by an order of magnitude higher permanent twist than is possible with heat treated steels.

A number of metals display what is known as a martensitic transformation. The martensitic transformation is a rearrangement of the crystallographic structure without any change in the chemical composition of the crystal structure and results in a material characterized by new mechanical properties. The transformation is diffusionless. Moreover, such transformation in materials in which they occur are spontaneous at certain temperatures. For instance, as the temperature of the material is dropped, a temperature point will be reached where a martensitic transformation will commence occurring spontaneously. This temperature is known as the Ms temperature. The martensitic transformation will progress further as the temperature of the material continues to be dropped until at a certain temperature, generally known as the Mf temperature, there will be maximum spontaneous martensitic transformation, that is, as much martensitic as can be formed will be formed. It has been found that the martensitic transformation can be started above Ms temperature if the material is plastically deformed, that is, if irreversible mechanical work is put into the material. However, there is a maximum temperature above which no martensitic transformation will occur even if deformation takes place. This temperature is known as the Md temperature. Moreover, it has been found that at temperatures below the Ms temperature, the martensitic transformation can be made to progress further than it normally would spontaneously, provided the material is mechanically deformed at such a temperature.

In view of this knowledge and finding, we have discovered that with torsion springs made of materials which exhibit a martensitic transformation, it is desirable to deform the spring blank at a temperature below the Md temperature, and, preferably, close to the Ms temperature and most preferably at or slightly below the Ms temperature. When the deformation of such blanks is performed at such temperatures, the blank will gain in strength not only due to the inelastic stretching of the material but also due to the crystallographic transformation of the material to the generally stronger martensitic phase.

This invention exploits the known fact that austenitic stainless steels are capable of extremely high strains with a concurrent permanent increase in ultimate and yield strengths when worked at temperatures where martensitic transformation takes place, i.e. between the Md and Ms temperatures. For many of the popular grades of stainless steel the Md temperature is near that of dry ice (−100° F) while the Ms temperature is very low and comparable to that of liquid nitrogen (−320° F). However, the novelty of the invention lies in the particular sequence of operations it employs to strain harden the material at the martensitic transformation temperatures.

The essential steps for making a torsion spring according to the invention are these:

1. Determine stress-strain relationships in tension and in torsion at the temperature at which the working will take place, e.g. the Md temperature of the material to be used. Preferably specimens of the actual batch of raw material to be used will be so tested. Also, determine the change in density undergone by this material during martensitic transformation.

2. Using this data establish the required dimensions of the workpiece prior to straining such that the strained article will have the desired dimensions without subsequent machining.

3. Fabricate the torsion bar blank according to the dimensions determined in step 2. Preferably the heavier end regions are created by upsetting the ends of the bar. The end splines are made by forming or machining grooves into the upset ends prior to straining operations.

4. Place the blank into an environment which brings its temperature below the Md temperature thereof.

5. Torsion load the blank to a stress level between the yield point and ultimate. The direction of twist must correspond to that which the torsion bar will experience when installed and in operation.

For this procedure to be of value, the bar must be made to substantially final dimensions, including the spline region, taking into account the decrease in density which occurs during the martensitic transformation. Machining the spline region after forming would adversely affect this bar by removing portions of the strengthened structure. It should be recognized that the spline bearing region will yield and deform somewhat. The dent produced by a loose mating spline will be straight except for the effect produced by small variations in elastic springback along the length of each spline. The deepest region of the spline cavity where no bearing occurs may twist with respect to the straight dent made by the external spline tooth.

The extensive straining in torsion with subsequent metallurgical changes in the grain structure, produces a substantially higher final strength than that achievable by cold working procedures normally used to harden these stainless steels. The yield strength is also increased substantially, and most significantly, a piece fabricated by this process achieves a high endurance limit. Although strength or endurance of this magnitude is exhibited by other steels, it is the unique combination of low cost, flexibility, beneficial higher residual stress, high strength, and high endurance obtained by this process, combined with the inherent corrosion resistance of the material, which produces a superior torsion bar.

A particularly significant point of superiority exists at the splines, where stress concentrations are responsible for many premature fatigue failures in existing bars. The toughness and notch resistance of bars made by the new process, aided by large regions of high beneficial residual stresses in the spline reduce the likelihood of this type of failure.

In one alternative, the spline region could be worked by compression, twisting or bending to strengthen them prior to cutting the splines and final twisting.

In other alternatives, some refinements to the basic procedure may be added if desired. For example, prior to the torsion working, the workpiece may be worked in tension at a martensitic transformation temperature to strengthen the spline regions before forming them on the bar ends. The tension load applied should be about 80–95% of the ultimate.

Also, after torsion working, the article could be precipitation hardened, for example by aging in a heated oven and subsequent cooling to room temperature without quenching. For a material such as ASTI 304 or ASTI 301 the torsion bar would be heated for 20 hours at 780°–790° F. The value of precipitation hardening depends on the degree of cold work; for severe cold work, precipitation reduces the resulting strength.

For a more complete understanding of the invention, reference may be had to the accompanying diagrams, in which.

Figure 1:
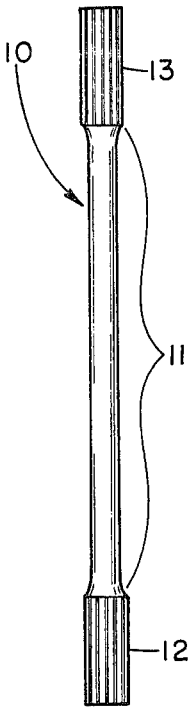
FIG. 1 illustrates a typical torsion bar of the invention.

The torsion bar 10, shown in FIG. 1, is an elongated steel bar having a working length 11 and splined ends 12, 13 which fit into cooperating fixtures (not shown) such as might be found in a motor vehicle suspension.

Figure 2:
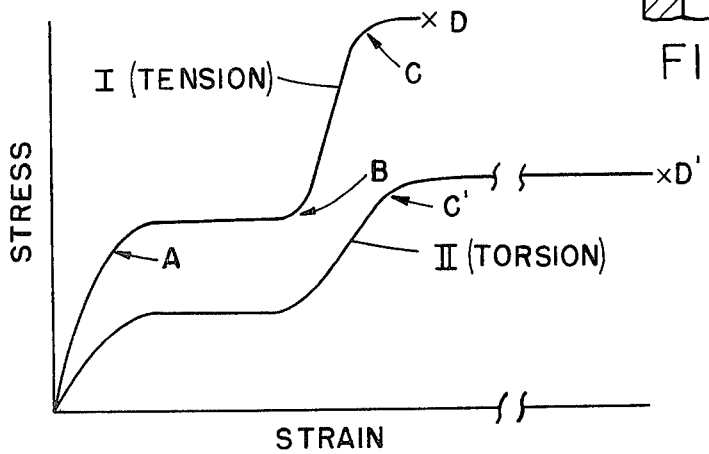
FIG. 2 is a graph showing typical stress-strain curves for a stainless steel alloy in torsion and tension.

The initial step in the manufacture of the torsion bar 10 in accordance with the present invention is to determine the stress-strain characteristics of the raw material to be used. These are determined by well known methods for the material in torsion and in tension, if desired, at or near the Ms or Md temperature of the material. FIG. 2 shows typical stress-strain characteristics for a material such as ASTI 304 stainless steel (without specific values for stress and strain). Curve I represents loading in tension, Curve II represents loading in torsion. The tensile curve is true-stress vs true-stain. The torsion curve is nominal stress vs strain. It will be seen that Curve I initially rises linearly, reaches an elastic limit at A, yields with small increases in stress to B, then rises substantially linearly to a knee C reaching an ultimate value at D, at which point the material ruptures. Curve II has a substantially similar shape except that the torsional strain which the material withstands after the knee C′ before rupture of the bar at D′ is many times the strains withstood in tension. Curves I and II are separated for clarity and no significance should be ascribed to their relative positions in FIG. 2, which Figure is intended to depict only the shape of characteristics.

Figure 3:
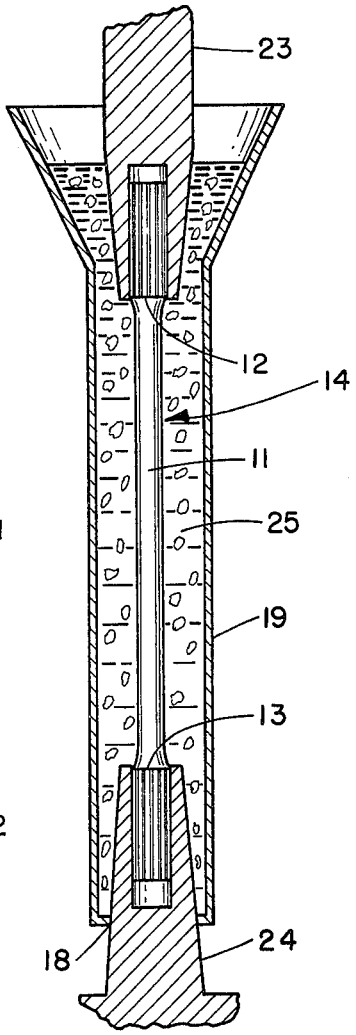
FIG. 3 illustrates the manufacturing set up for a typical blank from which a bar of the type shown in FIG. 1 is made.

With the information of curve II and density change measurements in hand, a blank 14 of that material (e.g. stainless steel ASTI 301 or 304) as shown in FIG. 1 is designed and fabricated, and placed into the jaws 23, 24 of a torsion machine (the rest of the machine is not shown) as seen in FIG. 3. The blank 14 comprises a central portion 11 and ends 12, 13 into which splines have been cut, formed or rolled. Preferably the blank 14 is made by upsetting the ends of a long bar to make the greater diameter ends 12, 13 rather than by machining away material from a rod of greater diameter in the interest of conservation of materials.

A cryostat 19, in FIG. 3 surrounds the blank 14 and rests on the lower jaw 24 sealing the aperture 18 in the cryostat 19. The cryostat 19 is filled with alcohol and dry ice 25 to bring the bar 14 near its Md temperature. The jaws 23, 24 are rotated relatively to one another, to twist the portion 11 of bar 10 and to work that portion cryogenically under torsion. This working, done in the region between C′ and D′ of the curve II, to impart the desired strength to the bar 10 is most effective at the surface of the bar where the more intensive working takes place due to its greater radius.

The direction of torsional stress applied during working must conform to the direction of stress encountered during operation. Since torsion bars on the right and left hand suspension of a motor vehicle are exposed to torsional stresses of opposite character, the torsion bars are made, using either clockwise or counterclockwise torsion stresses as appropriate.

Since the strengthening in this case is concentrated on the surface (the greater strains take place at a greater radius) it is imperative that the blank 14 can be designed initially to require minimum machining after forming in order that the strengthened material is not removed. To this end it must be recognized that a decrease in density (about 3.0%) occurs during martensitic transformation and proper steps must be taken to include that decrease in the design calculations. If the spline region is machined prior to strengthening by working, the spline region will deform more than when machined after initial strengthening.

This deficiency of excessive twisting may be alleviated somewhat by working the spline regions by pulling, compressing, twisting or bending so as to strengthen them prior to cutting the splines and the final twisting of the bar.

Figure 4:
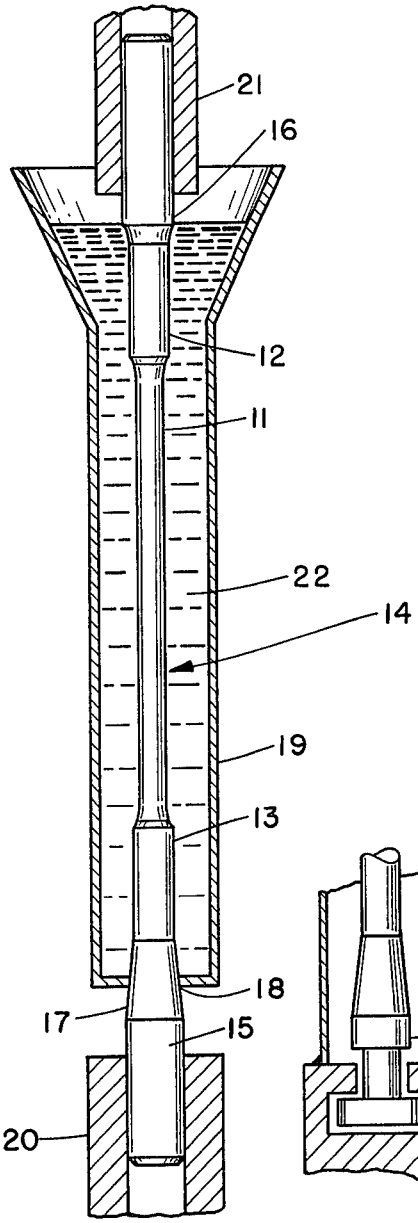
FIG. 4 illustrates an alternative step in the manufacturing process.

FIG. 4 shows an alternative prior step in the process involving initial tension working. The blank 14′ comprises a central portion 11, 12, 13 (corresponding to the portions 11, 12, 13 of FIG. 1) stretch end grips 15, 16 and a conical transition piece 17 between the grips 13 and 15. Preferably this blank is also made by upsetting and forming the ends of a long bar into the respective sections 12, 13, 15, 16 and 17 rather than by machining away material from a rod of considerably greater diameter than the central portion 11.

The stretch grip 16 of blank 14′ is fed through the aperture 18 in the bottom of cryostat 19, and the cryostat 19 set to rest on the conical piece 17 which effectively plugs up the aperture 18. Stretch grips 15 and 16 are placed in the jaws 20, 21 respectively of a stretching machine (not shown) and the cryostat 19 is filled with either dry ice or with liquid nitrogen 22 to bring the work piece 14' to a temperature near its Md or Ms temperature respectively.

The tensile machine (not shown) drives jaw 20, 21 apart thereby applying tension to the blank 14' which tension is increased gradually to a value of 80–90% of the yield stress, point D on Curve I. The blank 14' is removed from the stretcher and returned to room temperature.

Figure 4A:
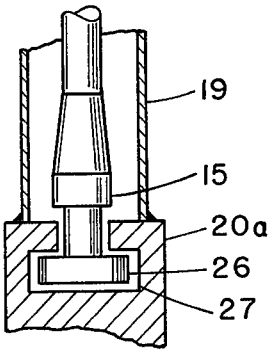
FIG. 4A illustrates a modification of FIG. 4.

An alternative grip which lends itself to more rapid capture in the machine is shown in FIG. 4A. Here, the stretch grip 15 terminates in a T-section 26. The grip 20*a* includes a socket 27 for capturing the section 26, and the cryostat wall is attached directly to the grip 20*a*. The T section may enter the socket from above and be locked therein by twisting, or the T-section may enter the socket from the front and slide therein. The particular arrangement used is not critical to the practice of this invention.

In yet another alternative, the jaws 20, 21 may apply compressive, twisting or bending forces to the spline regions 12, 13 rather than tension for the initial cold working.

Now, the torsion bar 11, 12, 13 is cut out from the blank 14' and the ends 12, 13 are machined to have splines appropriate for the holding sockets in which they are to be placed. Typically there may be more than 50 splines and the circumference, about 0.020 inch deep.

After the step illustrated in FIG. 4, and described in connection therewith, the torsion bar (having been cut free of the blank 14') is placed in the cryostat of FIG. 3 and torsion worked as described earlier.

After the torsion working the bar may be further strengthened by precipitation hardening by aging at 780°–790° F for 20 hours and subsequent slow cooling to room temperature without quenching.

It should be recognized that the methods here described are not limited to torsion springs but that other articles can benefit from the procedure here described. Propeller shafts for small boats, being primarily stressed torsionally in operation are particularly attractive subjects, for example. Retaining pins for tank treads is another example of a product which can be made by the method here described.

It is known that some austenitic stainless steels have Ms temperatures near absolute zero while others have Ms temperatures near that of dry ice. Some non-standard stainless steels even transform at room temperatures. It should be understood therefore that the terms Ms and Md temperatures in the claims appended hereto should be given their widest interpretation so as to cover all these situations. Although we prefer to use steels with Ms temperatures somewhat below the boiling point of liquid nitrogen −320° F and Md temperatures near that of dry ice −100° F we do not want to be limited to those steels.

We claim:

1. The method of making a torsion spring having a central working position and terminal grip end from an austensitic stainless steel material whose characteristics are known;

fabricating a blank of said material according to the desired final overall dimensions of said spring, including an allowance for density changes which are predictable from said characteristics;

shaping the terminal grip end on said blanks;

exposing said blank to a temperature at which martensitic transformation takes place, torsion working said blank at said temperature to apply thereto a stress greater than the yield stress of said material; and keeping said blank at substantially the same fabricated dimensions;

whereby the resulting torsion spring has high flexibility and high strength.

2. The method of claim 1 including the step of tension working said blank to a level of 80–95% of the ultimate prior to forming the grip ends at a temperature where spontaneous martensitic transformation occurs.

3. The method of claim 1 including the step of precipitation hardening said blank below 800° F after torsion working.

4. The method of claim 1 wherein torsion working temperature is −100° F.

5. The method of claim 2 wherein the tension working temperature is −320° and the torsion working temperature is −100° F.

6. The method of claim 3 wherein the precipitation hardening step consists of heating said blank to a temperature of 780°–790° F for a period of twenty hours and then cooling said blank to room temperature.

7. The method of claim 2 including the steps of precipitation hardening said blank after torsion working.

8. The method of claim 7 where in the precipitation hardening step consists of heating said blank to a temperature of 780°–790° F for a period of twenty hours and then cooling said blank to room temperature.

9. The method of making cylindrical bar-shaped articles of an austenitic stainless steel material including the steps of:

fabricating a blank of said material according to the desired dimension of said article;

stretching said blank at the Ms temperature of said material to apply thereto a stress of about 80–95% of the ultimate strength to tension work said blank;

twisting said blank at the Ms temperature to torsion work said blank following said tension working, and aging said blank by precipitation hardening following said torsion working.

10. The method of claim 9 wherein the direction of twist during torsion working is the same as the direction of twist to which the article is subjected during use.

11. The method of claim 10 wherein said blank is immersed in liquid nitrogen to obtain said Ms temperature for working in tension and in torsion.

12. The method of claim 11 wherein the precipitation hardening step consists of heating said blank to a temperature of 780°–790° F for a period of 20 hours, and slowly cooling said blank to room temperature without quenching.

13. The method of making a torsion spring having a central working section and grip ends thereon from in austenitic stainless steel including the step of:

fabricating a blank of said stainless steel substantially the final shape desired;

grooving the grip ends of said blank to form splines therein;

placing said blank in a temperature environment below the Md temperature of said material;

torsion loading said blank in said environment to a value of 80—95% of the ultimate value.

14. The method of making a torsion spring having a working region and end grips from an austenitic stainless steel material including the steps of:

fabricating a blank of said material according to predetermined dimensions and having tension grips, end grips and a working region thereon immersing said blank in liquid nitrogen to cool said blank to a temperature near its Ms temperature;

loading said blank in tension to about 80–90% of the ultimate stress of said material at said temperature;

removing said blank from said liquid nitrogen;

removing said tension grips from said blank;

immersing said blank in liquid nitrogen and loading said working region in torsion;

removing said blank from liquid nitrogen and heating said blank to a temperature of 780°–790° F for a period of about 20 hours;

cooling said blank to room temperature without quenching.

15. The method of claim 14 including the step of machining splines into said end grips after tension working and before torsion working said blank.

16. The method of making cylindrical bar-shaped articles of an austenitic stainless steel material including the steps of:

fabricating a blank of said material according to the desired dimension of said article, and twisting said blank at a martensitic transformation temperature between Md and Ms to torsion work said blank at a line greater than its yield strength.

17. The method of claim 16 for wherein the direction of twist during torsion working is the same as the direction of twist to which the article is subjected during use.

18. The method of claim 17 wherein said blank is immersed in liquid nitrogen to obtain said martensitic transformation temperature.

19. The method of claim 18 wherein a precipitation hardening step, consisting of heating said blank to a temperature of 780°–790° F for a period of twenty hours, and slowly cooling said blank to room temperature without quenching, follows said torsion working.

* * * * *